US008484777B2

(12) United States Patent
Shih

(10) Patent No.: US 8,484,777 B2
(45) Date of Patent: Jul. 16, 2013

(54) ELECTRIC MASSAGE BED

(75) Inventor: Chuan-Hang Shih, Changhua County (TW)

(73) Assignees: Ruoey Lung Enterprise Corp., Lu-Kang Township, Changhua County (TW); PPJ, LLC, Natick, MA (US)

( * ) Notice: Subject to any disclaimer, the term of this patent is extended or adjusted under 35 U.S.C. 154(b) by 0 days.

(21) Appl. No.: 13/344,881

(22) Filed: Jan. 6, 2012

(65) Prior Publication Data

US 2013/0025066 A1 Jan. 31, 2013

(30) Foreign Application Priority Data

Jul. 26, 2011 (TW) ..... 100213743 A

(51) Int. Cl.
*A61G 7/00* (2006.01)
*A61H 1/00* (2006.01)

(52) U.S. Cl.
USPC ..... 5/109; 5/933; 601/59

(58) Field of Classification Search
USPC ..... 5/915, 933, 108, 109; 601/49, 58–60
See application file for complete search history.

(56) References Cited

U.S. PATENT DOCUMENTS

| | | | | |
|---|---|---|---|---|
| 2,719,769 | A * | 10/1955 | Murphy | 5/618 |
| 6,006,379 | A * | 12/1999 | Hensley | 5/618 |
| 6,499,161 | B1 * | 12/2002 | Godette | 5/618 |
| 6,684,423 | B2 * | 2/2004 | Godette | 5/600 |
| 7,039,970 | B1 * | 5/2006 | Long | 5/600 |
| 7,465,280 | B2 * | 12/2008 | Rawls-Meehan | 601/56 |
| 8,146,188 | B2 * | 4/2012 | Hibler | 5/613 |

* cited by examiner

*Primary Examiner* — Michael Trettel
(74) *Attorney, Agent, or Firm* — Muncy, Geissler, Olds & Lowe, PLLC

(57) ABSTRACT

An electric massage bed includes a bed frame having a plurality of support brackets, a plurality of mattress sets each having a retaining plate mounted on one of the support brackets of the bed frame and a mattress supported by the retaining plate, and a vibrating motor mounted on a bottom side of the retaining plate of one of the mattress sets. When the vibration generated from the vibrating motor is transmitted to the associated mattress of the mattress set that is equipped with the vibrating motor, the unexpected vibration won't occur in the other mattress sets because the mattress sets are spaced from each other, thereby enhancing the comfort of a user lying down on the mattresses.

3 Claims, 2 Drawing Sheets

ELECTRIC MASSAGE BED

BACKGROUND OF THE INVENTION

1. Field of the Invention

The present invention relates generally to an electric massage bed, and more specifically to an electric massage bed that can enhance the comfort of every user.

2. Description of the Related Art

A conventional electric massage bed generally includes a bed frame and a plurality of retaining plates, which are mounted on the bed frame and pivotally connected with one another. A mattress of single piece is placed on the top sides of the retaining plates, and one or more vibrating motors are equipped on the bottom sides of the retaining plates. When the vibrations generated from the vibrating motors are transmitted to the mattress through the retaining plates, a massage effect can be applied to every user lying down on the mattress.

According to the aforesaid design, since the two adjacent retaining plates are connected with each other, the vibrations generated from the vibrating motors at local spots are easily transmitted to the whole area of the mattress, such that the user may feel unanticipated vibrations at various parts of the body. This may cause discomfort to the user, and meanwhile the unexpected vibrations may be transmitted to the retaining plates and the bed frame. Under the influence of the continuous vibrations, the vibrating motors may be dropped from the retaining plates that suffer the unexpected vibrations accidentally, and further a pivot pin provided between the two adjacent retaining plates or bolts provided in the bed frame may become loose to affect the structural stabilization of the electric massage bed. What is more serious is that because of the unexpected vibrations, the bed frame may get broken to threaten the safety of the user. Therefore, it is desirable to provide an electric massage bed to eliminate the aforementioned problems.

SUMMARY OF THE INVENTION

The present invention has been accomplished in view of the above-noted circumstances. It is therefore one objective of the present invention to provide an electric massage bed, which has a stable structure, and can enhance the comfort in use and prevent the spread of fire when one of the mattresses is on fire.

To achieve this objective of the present invention, the electric massage bed comprises a bed frame having a plurality of support brackets pivotally connected with one another, a plurality of mattress sets each including a mattress and a retaining plate having a bottom side mounted on one of the support brackets of the bed frame and a top side for supporting the mattress, and a vibrating motor mounted on the bottom side of the retaining plate of one of the mattress sets. By this way, when the vibration generated from the vibrating motor is transmitted to the associated mattress of the one of the mattress set, the unexpected vibration won't occur in the other mattress sets due to the separation between the two adjacent mattress sets, thereby enhancing the comfort of a user lying down on the mattresses and preventing the bed frame from getting damage so as to increase the structural stabilization of the electric massage bed. In addition, when one of the mattress sets is on fire, the fire will not spread over the all mattress sets because those mattress sets are basically separated from each other without connection therebetween.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
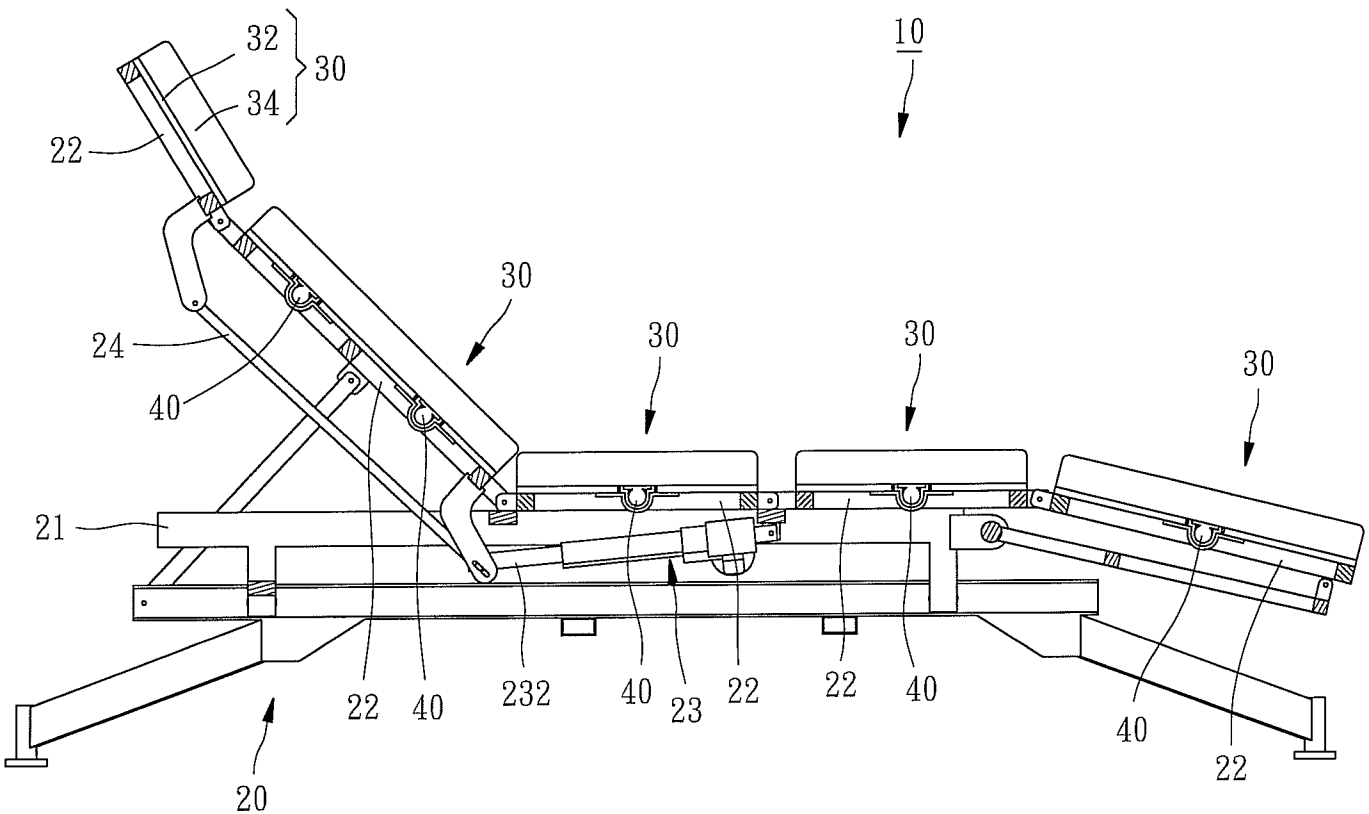
FIG. 1 is a schematic drawing of the electric massage bed according to an embodiment of the present invention.

As shown in FIG. 1, an electric massage bed 10 in accordance with a preferred embodiment of the present invention comprises a bed frame 20, five mattress sets 30, and five vibrating motors 40.

The bed frame 20 includes a base 21, five support brackets 22 mounted on the base 21 and pivotally connected with one another, and a driver 23 having one end thereof pivotally connected with the base 21 and provided with an extendable rod 232 at the other end. A link rod 24 can be driven by the extendable rod 232 of the driver 23 to actuate two of the adjacent support brackets 22 to pivot relative to each other. Preferably, the number of the support brackets 22 is adjusted according to actual needs.

Figure 2:
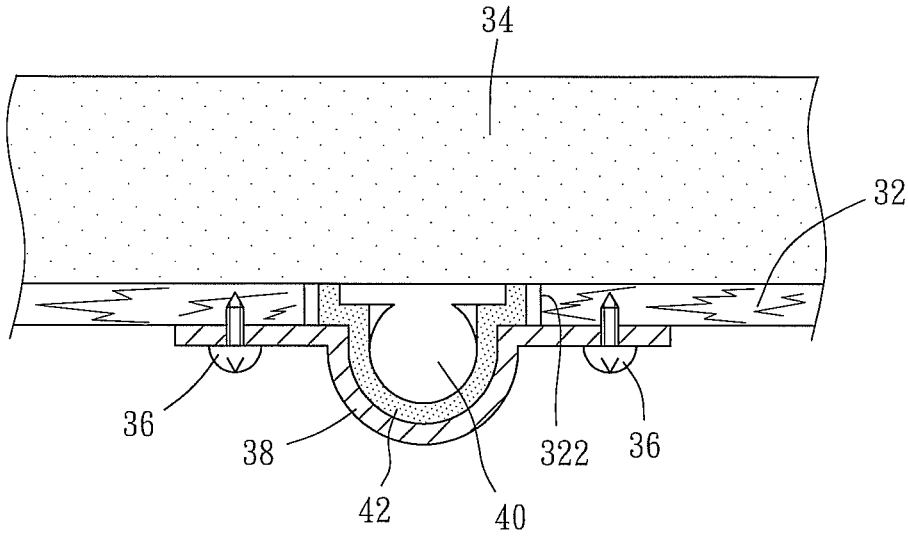
FIG. 2 is a partially sectional view of the electric massage bed according to the embodiment of the present invention, showing the way of installation of the vibrating motor.

The mattress sets 30 each include a retaining plate 32 having a bottom side mounted on one of the support brackets 22 of the bed frame 20, and a mattress 34 supported on a top side of the associated retaining plate 32. In this embodiment, the retaining plates 32 each have an accommodation space 322 covered by a protecting cover 38 fastened to one of the retaining plates 32 through a plurality of screws 36, as shown in FIG. 2.

The vibrating motors 40 are respectively received in the accommodation spaces 322 of the retaining plates 32 of the mattress sets 30 so as to be covered by the protecting covers 38 respectively. Each vibrating motor 40 is abutted against a bottom side of one of the mattress 34. Further, a cushion 42, which is made of foam member, rubber member or the like, is disposed between the vibrating motor 40 and the protecting cover 38 for absorbing the vibration generated from the vibrating motor 40, as show in FIG. 2.

By means of the aforesaid design, when the vibration generated from one of the vibrating motors 40 is transmitted to the associated mattress 34, the aforesaid vibration won't be transmitted to the other mattress set 30 since two adjacent mattress sets 30 are separated from each other. Therefore, a user will feel the vibration in a specific body part without getting unexpected vibrations in other body parts when lying down on the mattresses 34, thereby enhancing the comfort of the user. Further, the vibration created by the vibrating motor 40 can be absorbed by the cushion 42 for preventing bolts or the screws 36 from coming loose from the bed frame 20 or other vibrating motors 40, thereby increasing the structural stabilization of the electric massage bed 10 of the present invention. Furthermore, if one of the mattress sets 30 catches fire accidentally, the fire will not spread to the rest of the mattress sets 30 because the mattress sets 30 are separated from each other without connection therebetween.

Figure 3:
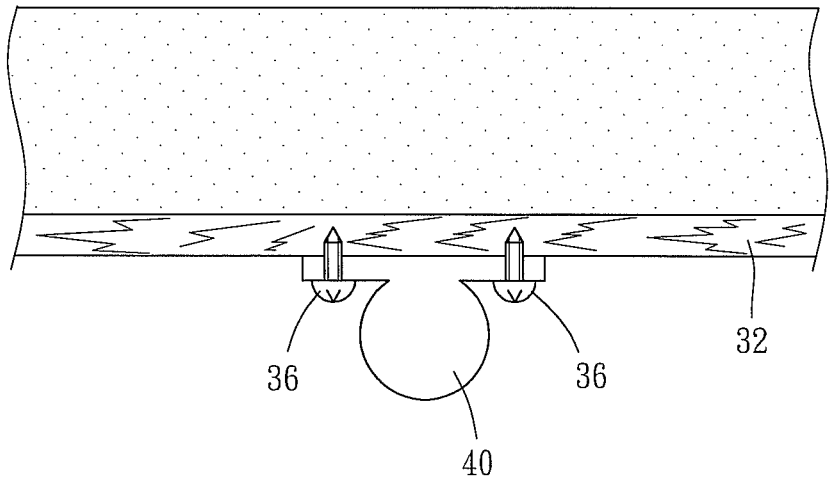
FIG. 3 is similar to FIG. 2, but showing an alternate way of installation of the vibrating motor.

To deserve to be mentioned, the way of installing the vibrating motor 40 to the retaining plate 32 can be changeable. As shown in FIG. 3, the vibrating motor 40 is directly fastened to the bottom side of the retaining plate 32 through the screws 36 for creating a similar vibration effect. Besides, the electric massage bed 10 of the present invention can be provided with one or more vibrating motors 40 according to the actual needs.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electric massage bed comprising:

a bed frame having a plurality of support brackets, two adjacent said support brackets being pivotally connected with each other;

a plurality of mattress sets each including a mattress and a retaining plate, the retaining plate having a bottom side mounted on one of the support brackets of the bed frame and a top side for supporting the mattress, the retaining plate further having an accommodation space; and a vibrating motor received in the accommodation space of the retaining plate and abutted against a bottom side of the mattress of one of the mattress sets.

2. The electric massage bed as claimed in claim 1, wherein a protecting cover is covered on the vibrating motor and a cushion is disposed between the vibrating motor and the protecting cover.

3. The electric massage bed as claimed in claim 1, wherein a link rod is driven by a driver mounted with the bed frame for actuating two adjacent said support brackets to pivot relative to each other.

* * * * *